US007476774B2

(12) United States Patent
Umansky et al.

(10) Patent No.: US 7,476,774 B2
(45) **Date of Patent: *Jan. 13, 2009**

(54) LIQUID PHASE AROMATICS ALKYLATION PROCESS

(75) Inventors: Benjamin S. Umansky, Fairfax, TX (US); Michael C. Clark, Pasadena, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 222 days.

This patent is subject to a terminal disclaimer.

(21) Appl. No.: 11/362,139

(22) Filed: Feb. 27, 2006

(65) Prior Publication Data

US 2006/0194996 A1 Aug. 31, 2006

Related U.S. Application Data

(60) Provisional application No. 60/656,946, filed on Feb. 28, 2005.

(51) Int. Cl.
*C07C 2/66* (2006.01)

(52) U.S. Cl. ..... 585/467; 585/449

(58) Field of Classification Search ..... 585/448, 585/467

See application file for complete search history.

(56) References Cited

U.S. PATENT DOCUMENTS

| | | | | |
|---|---|---|---|---|
| 2,381,175 | A * | 8/1945 | Mattox | 585/316 |
| 3,751,504 | A | 8/1973 | Keown | 260/672 |
| 4,016,218 | A | 4/1977 | Haag | 260/671 |
| 4,169,111 | A | 9/1979 | Wight | 585/323 |
| 4,459,426 | A | 7/1984 | Inwood | 585/323 |
| 4,547,605 | A | 10/1985 | Kresge | 585/467 |
| 4,891,458 | A | 1/1990 | Innes | 585/323 |
| 4,954,325 | A | 9/1990 | Rubin | 423/328 |
| 4,956,514 | A | 9/1990 | Chu | 585/533 |
| 4,992,606 | A | 2/1991 | Kushnerick | 585/467 |
| 5,003,119 | A | 3/1991 | Sardina et al. | |
| 5,073,653 | A | 12/1991 | Butler | |
| 5,077,445 | A | 12/1991 | Le | 585/467 |
| 5,175,185 | A | 12/1992 | Chandraratha | 514/445 |
| 5,185,486 | A | 2/1993 | Collin et al. | |

(Continued)

FOREIGN PATENT DOCUMENTS

CN 1464035 12/2003

(Continued)

OTHER PUBLICATIONS

PCT Search Report.

(Continued)

*Primary Examiner*—Thuan Dinh Dang
(74) *Attorney, Agent, or Firm*—Gerald L. Harris

(57) ABSTRACT

A process for the production of high octane number gasoline from light refinery olefins and benzene-containing aromatic streams such as reformate. Light olefins including ethylene and propylene are extracted from refinery off-gases, typically from the catalytic cracking unit, into a light aromatic stream such as reformate containing benzene and other single ring aromatic compounds which is then reacted with the light olefins to form a gasoline boiling range product containing akylaromatics. The alkylation reaction is carried out in the liquid phase with a catalyst which preferably comprises a member of the MWW family of zeolites such as MCM-22 using a fixed catalyst bed.

10 Claims, 2 Drawing Sheets

U.S. PATENT DOCUMENTS

| | | | | |
|---|---|---|---|---|
| 5,236,575 | A | 8/1993 | Bennett | 208/46 |
| 5,334,795 | A | 8/1994 | Chu | 585/467 |
| 5,336,820 | A * | 8/1994 | Owen et al. | 585/323 |
| 5,371,310 | A | 12/1994 | Bennett | 585/467 |
| 5,493,065 | A | 2/1996 | Cheng | 585/467 |
| 5,900,520 | A | 5/1999 | Mazzone | 585/467 |
| 5,902,917 | A | 5/1999 | Collin | 585/323 |
| 5,907,073 | A | 5/1999 | Ghosh | 585/467 |
| 6,025,534 | A | 2/2000 | Valente | |
| 6,051,521 | A | 4/2000 | Cheng | 502/86 |
| 6,060,632 | A | 5/2000 | Takamatsu | 585/467 |
| 6,703,356 | B1 | 3/2004 | Wu | 508/591 |
| 2004/0171899 | A1 | 9/2004 | Pohl | |
| 2004/0242404 | A1 | 12/2004 | Hwang et al. | |

FOREIGN PATENT DOCUMENTS

| | | | |
|---|---|---|---|
| WO | WO 01/83408 | A1 | 11/2001 |
| WO | WO 01/96013 | A1 | 12/2001 |
| WO | WO 03/076074 | A1 | 9/2003 |
| WO | WO 2004/085062 | A1 | 10/2004 |

OTHER PUBLICATIONS

R. J. Hengstebeck, "Petroleum Processing Principles and Applications", (1959), pp. 212-218, New York, McGraw-Hill Book Company, Lib. Cong. Cat. No. 58-13006.

International Search Report, PCT/US2007/017172, mailed Feb. 22, 2008.

Written Opinion, PCT Application No. PCT/US2007/017172, mailed Feb. 22, 2008.

* cited by examiner

LIQUID PHASE AROMATICS ALKYLATION PROCESS

CROSS REFERENCE TO RELATED APPLICATIONS

This application claims priority from U.S. application Ser. No. 60/656,946, filed 28 Feb. 2005, entitled "Liquid Phase Aromatics Alkylation Process".

This application is related to co-pending applications Ser. Nos. 11/362,257; 11/362,256: 11/362,255 and 11/362,128, of even date, claiming priority, respectively from applications Ser. Nos 60/656,954, 60/656,955, 60/656,945 and 60/656,947, all filed 28 Feb. 2006 and entitled respectively, "Gasoline Production By Olefin Polymerization", "Process for Making High Octane Gasoline with Reduced Benzene Content". "Vapor Phase Aromatics Alkylation Process" and "olefins Upgrading Process", now published as U.S. Patent Publication Nos. 2006/0194999; 2006/0194998; 2006/0194997 and 2006/019495.

Reference is made to the above applications for further details of the combined, integrated process described below as they are referred to in this application.

FIELD OF THE INVENTION

This invention relates to a process for the production of gasoline boiling range motor fuel by the reaction of light olefins with aromatic hydrocarbons in the liquid phase.

BACKGROUND OF THE INVENTION

In recent years, environmental laws and regulations the have limited the amount of benzene which is permissible in petroleum motor fuels. These regulations have produced substantial changes in refinery operation. To comply with these regulations, some refineries have excluded $C_6$ compounds from reformer feed so as to avoid the production of benzene directly. An alternative approach is to remove the benzene from the reformate after it is formed by means of an aromatics extraction process such as the Sullfolane Process or UDEX Process. Well-integrated refineries with aromatics extraction units associated with petrochemical plants usually have the ability to accommodate the benzene limitations by diverting extracted benzene to petrochemicals uses but it is more difficult to meet the benzene specification for refineries without the petrochemical capability. While sale of the extracted benzene as product to petrochemicals purchasers is often an option, it has the disadvantage of losing product to producers who will add more value to it and, in some cases, transportation may present its own difficulties in dealing with bulk shipping of a chemical classed as a hazardous material.

The removal of benzene is, however, accompanied by a decrease in product octane quality since benzene and other single ring aromatics make a positive contribution to product octane. Certain processes have been proposed for converting the benzene in aromatics-containing refinery streams to the less toxic alkylaromatics such as toluene and ethyl benzene which themselves are desirable as high octane blend components. One process of this type was the Mobil Benzene Reduction (MBR) Process which, like the closely related MOG Process, used a fluidized zeolite catalyst in a riser reactor to alkylate benzene in reformate to from alkylaromatics such as toluene. The MBR and MOG processes are described in U.S. Pat. Nos. 4,827,069; 4,950,387; 4,992,607 and 4,746,762.

Another problem facing petroleum refineries without convenient outlets for petrochemical feedstocks is that of excess light olefins. Following the introduction of catalytic cracking processes in petroleum refining in the early 1930s, large amounts of olefins, particularly light olefins such as ethylene, propylene, butylene, became available in copious quantities from catalytic cracking plants in refineries. While these olefins are highly useful as petrochemical feedstocks, the refineries without petrochemical capability or economically attractive and convenient markets for these olefins may have to use the excess light olefins in fuel gas, at a significant economic loss or, alternatively, convert the olefins to marketable liquid products. A number of different polymerization processes for producing liquid motor fuels from cracking off-gases evolved following the advent of the catalytic cracking process but at the present, the solid phosphoric acid [SPA] polymerization process remains the most important refinery polymerization process for the production of motor gasoline. This process has however, its own drawbacks, firstly in the need to control the water content of the feed closely because although a limited water content is required for catalyst activity, the catalyst softens in the presence of excess water so that the reactor may plug with a solid, stone-like material which is difficult to remove without drilling or other arduous operations. Conversely, if the feed is too dry, coke tends to deposit on the catalyst, reducing its activity and increasing the pressure drop across the reactor. Environmental regulation has also affected the disposal of cracking olefins from these non-integrated refineries by restricting the permissible vapor pressure (usually measured as Reid Vapor Pressure, RVP) of motor gasolines especially in the summer driving season when fuel volatility problems are most noted, potentially creating a need for additional olefin utilization capacity.

Refineries without their own petrochemicals plants or ready markets for benzene or excess light olefins therefore encounter problems from two different directions and for these plants, processes which would enable the excess olefins and the benzene to be converted to marketable products would be desirable.

The fluid bed MBR Process uses a shape selective, metallosilicate catalyst, preferably ZSM-5, to convert benzene to alkylaromatics using olefins from sources such as FCC or coker fuel gas, excess LPG or light FCC naphtha. Normally, the MBR Process has relied upon light olefin as alkylating agent for benzene to produce alkylaromatics, principally in the $C_7$-$C_8$ range. Benzene is converted, and light olefin is also upgraded to gasoline concurrent with an increase in octane value. Conversion of light FCC naphtha olefins also leads to substantial reduction of gasoline olefin content and vapor pressure. The yield-octane uplift of MBR makes it one of the few gasoline reformulation processes that is actually economically beneficial in petroleum refining.

Like the MOG Process, however, the MBR Process required considerable capital expenditure, a factor which did not favor its widespread application in times of tight refining margins. The MBR process also used higher temperatures and $C_5$+ yields and octane ratings could in certain cases be deleteriously affected another factor which did not favor widespread utilization. Other refinery processes have also been proposed to deal with the problems of excess refinery olefins and gasoline; processes of this kind have often functioned by the alkylation of benzene with olefins or other alkylating agents such as methanol to form less toxic alkylaromatic precursors. Exemplary processes of this kind are described in U.S. Pat. Nos. 4,950,823; 4,975,179; 5,414,172; 5,545,788; 5,336,820; 5,491,270 and 5,865,986.

While these known processes are technically attractive they, like the MOG and MBR processes, have encountered the disadvantage of needing to a greater or lesser degree, some capital expenditure, a factor which militates strongly against them in present circumstances.

For these reasons, a refinery process capable of being installed at relatively low capital cost and having the capability to alkylate benzene (or other aromatics) with the olefins would be beneficial to meet gasoline benzene specifications, increase motor fuel volume with high-octane alkylaromatic compounds and be economically acceptable in the current plant investment climate. For some refineries, the reactive removal of $C_2/C_3$ olefins could alleviate fuel gas capacity limitations. Such a process should:

- Upgrade $C_2$ and $C_3$ olefin from fuel gas to high octane blending gasoline Increase flexibility in refinery operation to control benzene content in the gasoline blending pool
- Allow refineries with benzene problems to feed the $C_6$ components (low blending octane values) to the reformer, increasing both the hydrogen production from the reformer and the blend pool octane. Benzene produced in the reformer will be removed in order to comply with gasoline product specifications.
- Have the potential, by the removal of olefins from the fuel gas, to increase capacity in the fuel system facility. For some refineries this benefit could allow an increase in severity in some key refinery process, FCC, hydrocracker, coker, etc.

The necessity of keeping capital cost low obviously favors fixed bed catalytic units over the fluid bed type operations such as MOG and MBR. Fixed bed aromatics alkylation processes have achieved commercial scale use in the petrochemical field. The Cumene Process offered for license first by Mobil Oil Corporation and now by ExxonMobil Chemical Company is a low-capital cost process using a fixed bed of a zeolite alkylation/transalkylation catalyst to react refinery propylene with benzene to produce petrochemical grade cumene. Processes for cumene manufacture using various molecular sieve catalysts have been described in the patent literature: for example, U.S. Pat. No. 3,755,483 describes a process for making petrochemical cumene from refinery benzene and propylene using a fixed bed of ZSM-12 catalyst; U.S. Pat. No. 4,393,262 and U.S. also describe processes for making cumene from refinery benzene and propylene using ZSM-12 catalysts. The use of other molecular sieve catalysts for cumene manufacture has been described in other patents: U.S. Pat. No. 4,891,458 describes use of a zeolite beta catalyst; U.S. Pat. No. 5,149,894 describes the use of a catalyst containing the sieve material SSZ-25; U.S. Pat. No. 5,371,310 describes the use of a catalyst containing the sieve material MCM-49 in the transalkylation of diisopropyl benzene with benzene; U.S. Pat. No. 5,258,565 describes the use of a catalyst containing the sieve material MCM-36 to produce petrochemical grade cumene containing less than 500 ppm xylenes.

The petrochemical alkylation processes such as those referred to above, do not lend themselves directly to use in petroleum refineries without petrochemical capacity since they require pure feeds and their products are far more pure than required in fuels production. In addition, other problems may be encountered in the context of devising a process for motor gasoline production which commends itself for use in non-integrated, small-to-medium sized refineries. One such problem is the olefins from the cracker contain ethylene and propylene in addition to the higher olefins and if any process is to be economically attractive, it is necessary for it to consume both of the lightest olefins. Propylene is more reactive than ethylene and will form cumene by reaction with benzene at lower temperatures than ethylene will react to form ethylbenzene or xylenes (by transalkylation or disporportionation). Because of this, it is not possible with existing process technologies, to obtain comparable utilization of ethylene and propylene in a process using a mixed olefin feed from the FCCU. While improved ethylene utilization could in principle, be achieved by higher temperature operation, the thermodynamic equilibrium for the propylene/benzene reaction shifts away from cumene at temperatures above about 260° C. (500° F.), with consequent loss of this product.

In co-pending application Ser. No. 60/656,945(U.S. 2006/0194997) entitled "Vapor Phase Aromatics Alkylation Process", a process is described for alkylating light refinery aromatics streams containing benzene with the light olefins (ethylene, propylene) from the FCC unsaturated gas plant (USGP). The process described in that application has the objective of utilizing the different reactivities of the ethylene and propylene by reaction over two different catalysts under conditions appropriate to each olefin. In this way, the conversion of both the ethylene and propylene is optimized with assured benzene conversion. That process operates in the vapor phase with temperatures as high as about 350° C (about 660° F) which does impose some extra economic penalty, compared to a process capable of operating at lower temperatures. In addition, the larger volume associated with vapor phase operation may make limit unit capacity with smaller volume existing units are converted to this process. It would therefore be desirable to offer a process operating at lower temperatures in the denser liquid phase.

SUMMARY OF THE INVENTION

We have now devised a process which enables light refinery olefins from the cracker (FCCU) to be utilized for the alkylation of benzene from refinery sources to produce gasoline boiling range products. The process achieves good utilization of both the ethylene and the propylene present in a mixed olefin feed from the unsaturated gas plant (USGP) while operating under conditions favorable to the utilization of both these olefins. Thus, the present process enables the refinery to comply with gasoline benzene specifications while making good use of the mixed olefins from the FCCU. The process is operated as a fixed bed process which requires only limited capital outlay and is therefore eminently suitable for implementation in small-to-medium sized refineries; in fact, being a relatively low pressure process, it may be operated in existing low pressure units with a minimal amount of modification.

According to the present invention, light olefins including ethylene and propylene, are extracted from the FCCU off-gases using a light aromatic stream such as reformate which contains benzene or other single ring aromatic compounds, e.g. xylene, as the extractant. The solution of dissolved light olefins is then passed to a fixed bed reactor in which the aromatics in the stream are alkylated with the olefins in a liquid phase reaction, to form a gasoline boiling range [$C_5$+-200° C.] [$C_5$+-400° F.] product containing akylaromatics. The reaction is carried out in the presence of a catalyst which comprises a member of the MWW family of zeolites.

DRAWINGS

DETAILED DESCRIPTION OF THE INVENTION

Process Configuration

Figure 1:
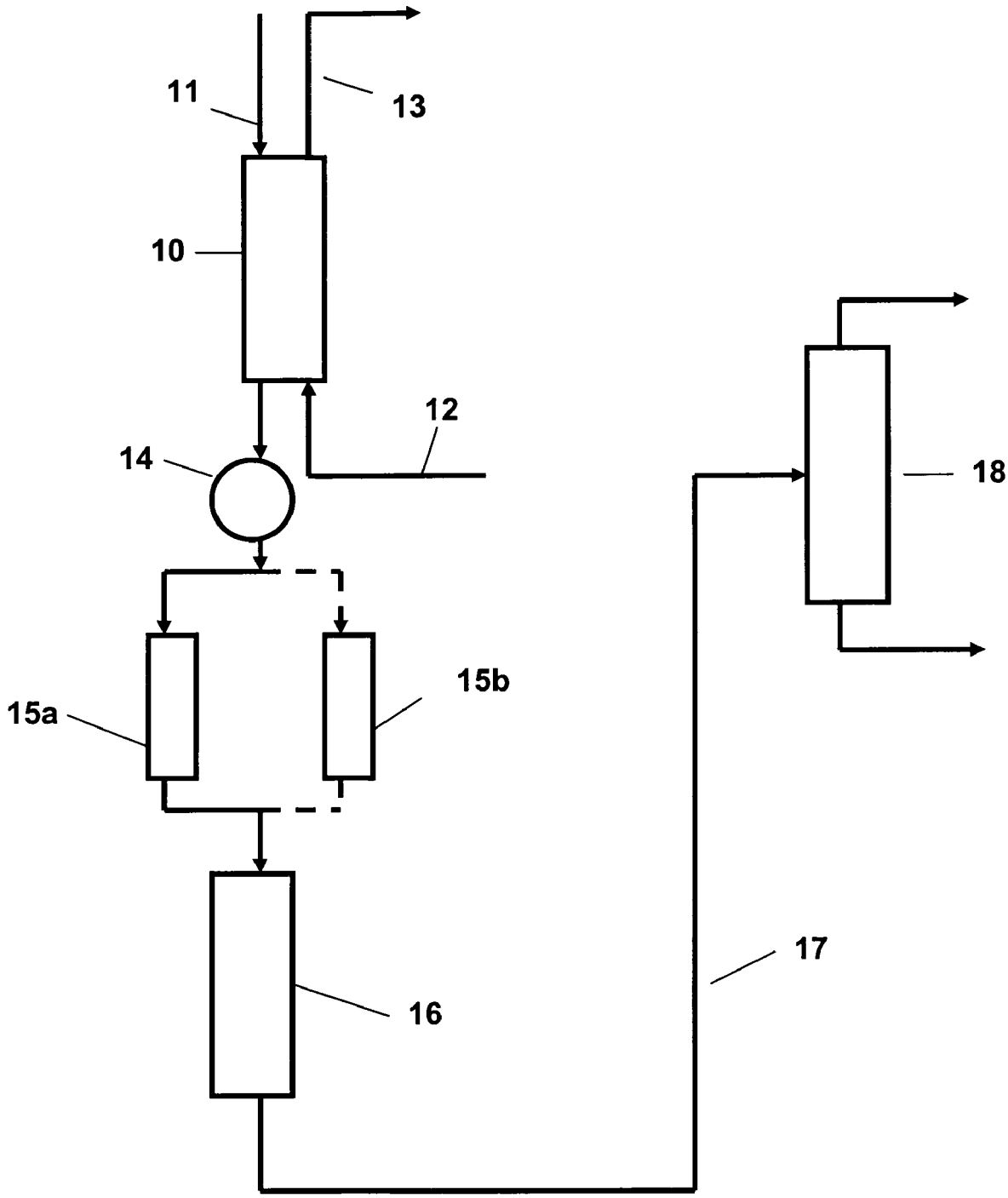
FIG. 1 shows a process schematic for the aromatics alkylation unit for converting mixed light refinery olefins and benzene to motor gasoline in a liquid-phase, fixed bed reaction.

A schematic for an olefin alkylation unit is shown in simplified from in FIG. 1. A stream of off-gases from the fluid catalytic cracking unit (FCCU) including light mixed olefins. typically $C_2$ and $C_3$ olefins (ethylene and propylene) with some $C_4$ olefins and paraffins as well as light paraffins (methane, ethane, propane) Is led into absorber 10 through line 11; a light aromatic stream containing benzene also enters absorber 10 through line 12. In the absorber, the liquid aromatic stream sorts the olefins selectively from the FCC off-gases. The components in the FCC off-gases which are not sorbed by the aromatic stream, mainly the light paraffins methane, ethane, propane and butane pass out of the absorber through line 13 and can used as refinery fuel gas. The mixed olefin/benzene Charge passes to heater 14 to guard bed reactor 15*a* The guard bed may be operated on the swing cycle with two beds, 15*a*,15*b*,one bed being used on stream for contaminant removal and the other on regeneration in the conventional manner. If desired, a three-bed guard bed system may be used with the two beds used in series for contaminant removal and the third bed on regeneration. With a three guard system used to achieve low contaminant levels by the two-stage series sorption, the beds will pass sequentially through a three-step cycle of: regeneration, second bed sorption, first bed sorption.

From the guard bed, the reaction mixture of olefins and reformate passes to alkylation reactor 16 in which the mixed olefin feed is reacted with the benzene and other single ring aromatics over a fixed bed of alkylation catalyst to form the desired alkylaromatic product. The alkylate product passes through line 17 to fractionator 18 in which it is separated into light ends, mainly light paraffin by-product from the alkylation reaction, and the desired alkylaromatic fraction in the gasoline boiling range.

The alkylation reaction is carried out in the liquid phase at relatively mild temperatures and no diluent or quench is normally required to handle heat release. Accordingly, the equipment is simple and, with no diluent passing through the reactor, full utilization of reactor capacity is achieved. The preferred class of alkylation catalysts for this reaction step are the catalysts based on a MWW zeolite, as described below.

The catalyst used in the guard bed will normally be the same catalyst used in the alkylation reactor as a matter of operating convenience but this is not required: if desired another catalyst or sorbent to remove contaminants from the feed may used, typically a cheaper guard bed sorbent, e.g a used catalyst from another process or an alumina sorbent. The objective of the guard bed is to remove the contaminants from the feed before the feed comes to the reaction catalyst and provided that this is achieved, there is wide variety of choice as to guard bed catalysts and conditions useful to this end.

Olefin Feed

The light olefins used as the feed for the present process are normally obtained by the catalytic cracking of petroleum feedstocks to produce gasoline as the major product. The catalytic cracking process, usually in the form of fluid catalytic cracking (FCC) is well established and, as is well known, produces large quantities of light olefins as well as olefinic gasolines and by-products such as cycle oil which are themselves subject to further refining operations. The olefins which are primarily useful in the present process are the lighter olefins from ethylene up to butene; although the heavier olefins up to octene may also be included in the processing, they can generally be incorporated directly into the gasoline product where they provide a valuable contribution to octane. The present process is highly advantageous in that it will operate readily not only with butene and propylene but also with ethylene and thus provides a valuable route for the conversion of this cracking by-product to the desired gasoline product. For this reason as well as their ready availability in large quantities in a refinery, mixed olefin streams such a FCC Off-Gas streams (typically containing ethylene, propylene and butenes) may be used. Conversion of the $C_3$ and $C_4$ olefin fractions from the cracking process provides a direct route to the branch chain $C_6$, $C_7$ and $C_8$ products which are so highly desirable in gasoline from the view point of boiling point and octane. Besides the FCC unit, the mixed olefin streams may be obtained from other process units including cokers, visbreakers and thermal crackers. The presence of diolefins which may be found in some of these streams is not disadvantageous since catalysis on the MWW family of zeolites takes place on surface sites rather than in the interior pore structure as with more conventional zeolites so that plugging of the pores is less problematic catalytically. Appropriate adjustment of the process conditions will enable co-condensation products to be produced when ethylene, normally less reactive than its immediate homologs, is included in the feed. The compositions of two typical FCC gas streams is given below in Tables 1 and 2, Table 1 showing a light FCC gas stream and Table 2 a stream from which the ethylene has been removed in the gas plant for use in the refinery fuel system.

TABLE 1

| FCC Light Gas Stream | | |
|---|---|---|
| Component | Wt. Pct. | Mol. Pct. |
| Ethane | 3.3 | 5.1 |
| Ethylene | 0.7 | 1.2 |
| Propane | 14.5 | 15.3 |
| Propylene | 42.5 | 46.8 |
| Iso-butane | 12.9 | 10.3 |
| n-Butane | 3.3 | 2.6 |
| Butenes | 22.1 | 18.32 |
| Pentanes | 0.7 | 0.4 |

TABLE 2

| $C_3$-$C_4$ FCC Gas Stream | |
|---|---|
| Component | Wt. Pct. |
| 1-Propene | 18.7 |
| Propane | 18.1 |
| Isobutane | 19.7 |
| 2-Me-1-propene | 2.1 |
| 1-Butene | 8.1 |
| n-Butane | 15.1 |
| Trans-2-Butene | 8.7 |
| Cis-2-butene | 6.5 |
| Isopentane | 1.5 |
| C3 Olefins | 18.7 |
| C4 Olefins | 25.6 |
| Total Olefins | 44.3 |

While the catalysts used in the present process are robust they do have sensitivity to certain contaminants (the conventional zeolite deactivators), especially organic compounds with basic nitrogen as well as sulfur-containing organics. It is therefore preferred to remove these materials prior to entering the unit if extended catalyst life is to be expected. Scrubbing with contaminant removal washes such as caustic, MEA or other amines or aqueous wash liquids will normally reduce the sulfur level to an acceptable level of about 10-20 ppmw and the nitrogen to trace levels at which it can be readily tolerated. One attractive feature about the present process is that it is not unduly sensitive to water, making it less necessary to control water entering the reactor than it is in SPA units. Unlike SPA, the zeolite catalyst does not require the presence of water in order to maintain activity and therefore the feed may be dried before entering the unit. In conventional SPA units, the water content typically needs to be held between 300 to 500 ppmw for adequate activity while, at the same time, retaining catalyst integrity. The present zeolite catalysts, however, may readily tolerate up to about 1,000 ppmw water although levels above about 800 ppmw may reduce activity, depending on temperature.

Aromatic Feed

In addition to the light olefin feed, an aromatic stream containing benzene is fed into the process, as described above. This stream may contain other single ring aromatic compounds including alkylaromatics such as toluene, ethylbenzene, propylbenzene (cumene) and the xylenes. In refineries with associated petrochemical capability, these alkylaromatics will normally be removed for higher value use as chemicals or, alternatively, may be sold separately for such uses. Since they are already considered less toxic than benzene, there is no environmental requirement for their inclusion in the aromatic feed stream but, equally, there is no prejudice against their presence unless conditions lead to the generation of higher alkylaromatics which fall outside the gasoline range or which are undesirable in gasoline, for example, durene. The amount of benzene in this stream is governed mainly by its source and processing history but in most cases will typically contain at least about 5 vol. % benzene, although a minimum of 12 vol. % is more typical, more specifically about 20 vol. % to 60 vol. % benzene. Normally, the main source of this stream will be a stream from the reformer which is a ready source of light aromatics. Reformate streams may be full range reformates, light cut reformates, heavy reformates or heart cut reformates. These fractions typically contain smaller amounts of lighter hydrocarbons, typically less than about 10% $C_5$ and lower hydrocarbons and small amounts of heavier hydrocarbons, typically less than about 15% $C_7$+ hydrocarbons. These reformate feeds usually contain very low amounts of sulfur as, usually, they have been subjected to desulfurization prior to reforming so that the resulting gasoline product formed in the present process contains an acceptably low level of sulfur for compliance with current sulfur specifications.

Reformate streams will typically come from a fixed bed, swing bed or moving bed reformer. The most useful reformate fraction is a heart-cut reformate. This is preferably reformate having a narrow boiling range, i.e. a $C_6$ or $C_6/C_7$ fraction. This fraction is a complex mixture of hydrocarbons recovered as the overhead of a dehexanizer column downstream from a depentanizer column. The composition will vary over a range depending upon a number of factors including the severity of operation in the reformer and the composition of the reformer feed. These streams will usually have the $C_5$, $C_4$ and lower hydrocarbons removed in the depentanizer and debutanizer. Therefore, usually, the heart-cut reformate may contain at least 70 wt. % $C_6$ hydrocarbons (aromatic and non-aromatic), and preferably at least 90 wt. % $C_6$ hydrocarbons.

Other sources of aromatic, benzene-rich feeds include a light FCC naphtha, coker naphtha or pyrolysis gasoline but such other sources of aromatics will be less important or significant in normal refinery operation.

By boiling range, these benzene-rich fractions can normally be characterized by an end boiling point of about 120° C. (250° F.), and preferably no higher than about 110° C. (230° F.). Preferably, the boiling range falls between 40° and 100° C. (100° F. and 212° F.), and more preferably between the range of 65° to 95° C. (150° F. to 200° F.) and even more preferably within the range of 70° to 95° C. (160° F. to 200° F.).

The compositions of two typical heart cut reformate streams are given in Tables 2 and 3 below. The reformate shown in Table 3 is a relatively more paraffinic cut but one which nevertheless contains more benzene than the cut of Table 2, making it a very suitable substrate for the present alkylation process.

TABLE 2

| C6-C7 Heart Cut Reformate | |
|---|---|
| RON | 82.6 |
| MON | 77.3 |
| Composition, wt. pct. | |
| i-$C_5$ | 0.9 |
| n-$C_5$ | 1.3 |
| $C_5$ napthenes | 1.5 |
| i-$C_6$ | 22.6 |
| n-$C_6$ | 11.2 |
| $C_6$ naphthenes | 1.1 |
| Benzene | 32.0 |
| i-$C_7$ | 8.4 |
| n-$C_7$ | 2.1 |
| $C_7$ naphthenes | 0.4 |
| Toluene | 17.7 |
| i-$C_8$ | 0.4 |
| n-$C_8$ | 0.0 |
| $C_8$ aromatics | 0.4 |

TABLE 3

| Paraffinic C6-C7 Heart Cut Reformate | |
|---|---|
| RON | 78.5 |
| MON | 74.0 |
| Composition, wt. pct. | |
| i-$C_5$ | 1.0 |
| n-$C_5$ | 1.6 |
| $C_5$ napthenes | 1.8 |
| i-$C_6$ | 28.6 |
| n-$C_6$ | 14.4 |
| $C_6$ naphthenes | 1.4 |
| Benzene | 39.3 |
| i-$C_7$ | 8.5 |
| n-$C_7$ | 0.9 |
| $C_7$ naphthenes | 0.3 |
| Toluene | 2.3 |

Reformate streams will come from a fixed bed, swing bed or moving bed reformer. The most useful reformate fraction is a heart-cut reformate. This is preferably reformate having a narrow boiling range, i.e. a $C_6$ or $C_6/C_7$ fraction. This fraction is a complex mixture of hydrocarbons recovered as the overhead of a dehexanizer column downstream from a depentanizer column. The composition will vary over a range depending upon a number of factors including the severity of operation in the reformer and the composition of the reformer feed. These streams will usually have the $C_5$, $C_4$ and lower hydrocarbons removed in the depentanizer and debutanizer. Therefore, usually, the heart-cut reformate will contain at least 70 wt. % $C_6$ hydrocarbons, and preferably at least 90 wt. % $C_6$ hydrocarbons.

Other sources of aromatic, benzene-rich feeds include a light FCC naphtha, coker naphtha or pyrolysis gasoline but such other sources of aromatics will be less important or significant in normal refinery operation.

By boiling range, these benzene-rich fractions can normally be characterized by an end boiling point of about 120° C. (250° F.), and preferably no higher than about 110° C. (230° F.). In most cases, the boiling range falls between 40° and 100° C. (100° F. and 212° F.), normally in the range of 65° to 95° C. (150° F. to 200° F. and in most cases within the range of 70° to 95° C. (160° F. to 200° F.).

Absorber

The aromatic feed and the light olefins pass in contact with one another in the absorber. Contact between the two feeds is carried out so as to promote sorption of the light olefins in the liquid aromatic stream. The absorber is typically a liquid/vapor contact tower conventionally designed to achieve good interchange between the two phases passing one another inside it. Such towers usually operate with countercurrent feed flows with the liquid passing downwards by gravity from its entry as lean solvent at the top of the tower while the gas is introduced at the bottom of the tower to pass upwards in contact with the descending liquid with internal tower arrangements to promote the exchange between the phases, for example, slotted trays, trays with bubble caps, structured packing or other conventional expedients. The rich solvent containing the sorbed olefins passes out from the bottom of the tower to pass to the alkylation reactor.

The degree to which the olefins are sorbed by the aromatic stream will depend primarily on the contact temperature and pressure, the ratio of aromatic stream to olefin volume, the compositions of the two streams and the effectiveness of the contacting tower. In general terms, sorption of olefin by the liquid feed stream will be favored by lower temperatures, higher pressures and higher liquid: olefin ratios. The effect of temperature and pressure on the olefin recovery the liquid stream is illustrated briefly in Table 4 below

TABLE 4

| Olefin Recovery | | |
|---|---|---|
| P, kPag (psig) | Temperature, C. (F.) | Percentage Olefin Recovery |
| 1172 (170) | 41 (105) | 58 |
| 1172 (170) | 16 (60) | 69 |
| 1724 (250) | 41 (105) | 69 |
| 1724 (250) | 16 (60) | 76 |
| 3450 (500) | 41 (105) | 69 |
| 3450 (500) | 16 (60) | 94 |

Thus, with absorber operating temperatures and pressures similar to those above. e.g. temperatures up to about 100° or 120° C., at pressures up to about 3500 kPag e.g. up to about 2000 kPag, olefin recoveries of 50 to 90 percent can be expected with contactors of conventional efficiency. Sorption of the heavier clef ins is favored with most aromatic streams so that the light gases leaving the absorber will be relatively enriched in these components. As noted in co-pending application Ser. No. 60/656,945 (U.S. 2006/0194997), entitled "Vapor Phase Alkylation Process", propylene is more reactive for aromatics alkylation at lower temperatures than ethylene and fat this reason, the preferential sorption of the propylene component is favorable for the subsequent liquid phase alkylation reaction which is conducted under relatively mild conditions. The conditions selected for absorber operation will therefore affect the ratio of the olefin and aromatic streams to the alkylation reactor. The ratio achieved should be chosen so that there is sufficient olefin to consume the benzene in the aromatic feed under the reaction conditions chosen. Normally, the ratio of olefin to aromatic required for the alkylation step will be in the range of 0.5:1 to 2:1 (see below) and the conditions in the absorber should be determined empirically to achieve the desired ratio.

Figure 2:
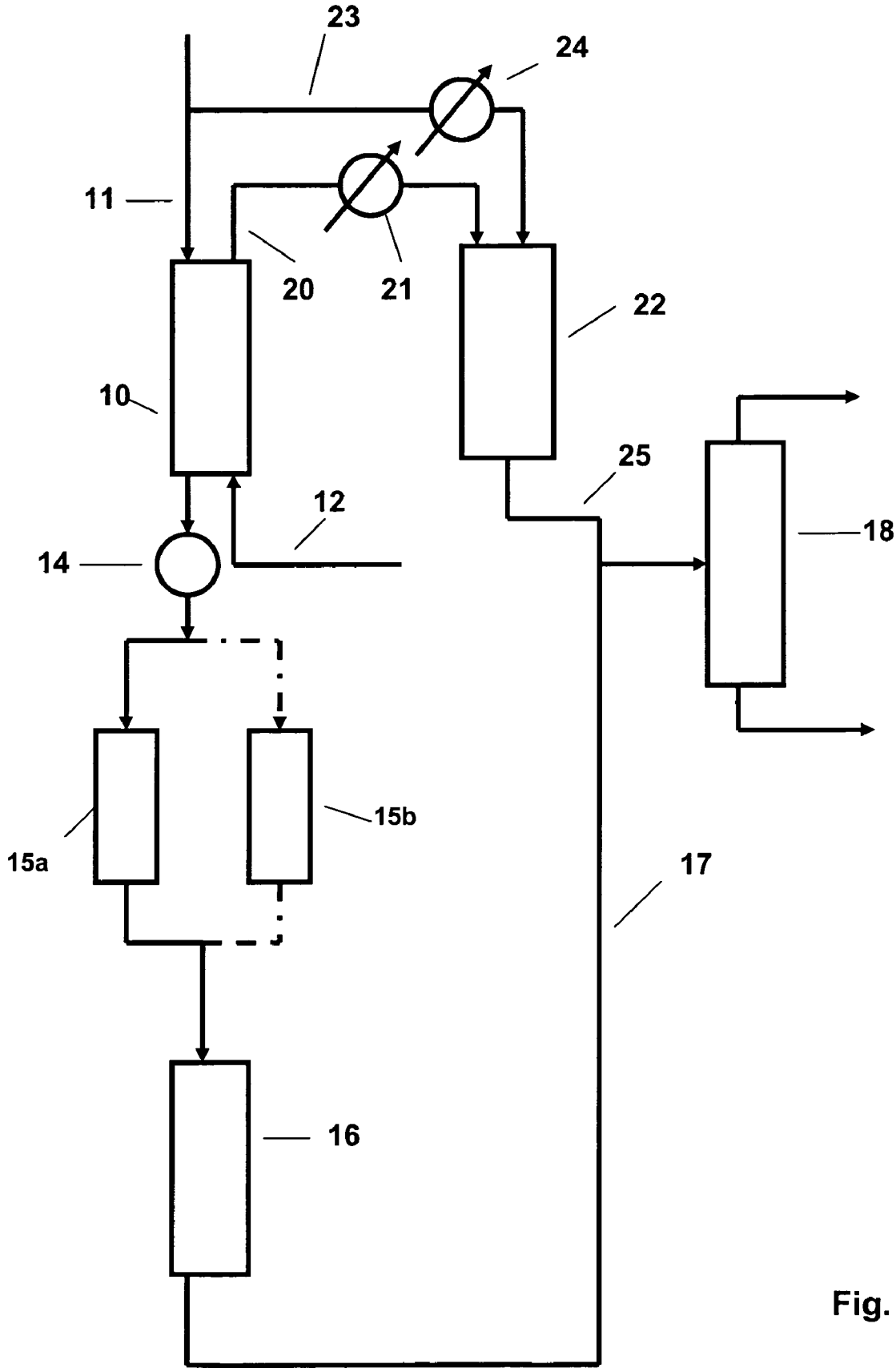
FIG. 2 shows a process schematic for the aromatics alkylation unit for converting mixed light refinery olefins and benzene to motor gasoline in a two stage, fixed bed reaction with initial liquid phase reaction.

The unsorbed olefins which pass out of the absorber will be comprised predominantly of the lighter olefins, principally ethylene which can be used in a separate, higher temperature alkylation step carded out in the vapor phase. FIG. 2 shows a simplified process schematic for doing this. The layout is similar to that of FIG. 1 with the same components identified by the same reference numerals. In the case of FIG. 2, however, the unsorbed olefin effluent from the absorber passes out of absorber through line 20 and then through heater and/or heat exchanger 21 to vapor phase alkylation reactor 22 which is also fed with additional aromatic feed through line 23 passing by way of heater/heat exchanger 24, with sufficient heat being provided to bring the reactants to the required temperature for the alkylation in reactor 22. In reactor 22, the lighter olefins, predominantly ethylene, are used to alkylate the aromatics in a fixed bed catalytic, vapor phase reaction which is preferably carried out over a catalyst comprising an intermediate pore size zeolite such as ZSM-5 which is more active for ethylene conversion than the MWW type zeolite favored for the liquid phase reaction in reactor 10. Alkylaromatic product is taken from reactor 22 by way of line 25 to fractionator 18 now serving as a common fractionator for both alkylation reactors.

Catalyst System

The catalyst system used in the liquid phase alkylation of the present process contain is preferably one based on a zeolite of the MWW family because these catalysts exhibit excellent activity for the desired aromatic alkylation reaction using light olefins, especially propylene. It is, however, possible to use other molecular sieve catalysts for this liquid phase alkylation, including catalysts based on ZSM-12 as described in U.S. Pat. Nos. 3,755,483 and 4,393,262 for the manufacture of petrochemical cumene from refinery benzene and propylene; catalysts based on zeolite beta as described in U.S. Pat. No. 4,891,458 or catalysts based on SSZ-25 as described in U.S. Pat. No. 5,149,894, all of which are reported to have activity for the alkylation of light aromatics by propylene.

MWW Zeolite

The MWW family of zeolite materials has achieved recognition as having a characteristic framework structure which presents unique and interesting catalytic properties. The MWW topology consists of two independent pore systems: a sinusoidal ten-member ring [10 MR] two dimensional channel separated from each other by a second, two dimensional pore system comprised of 12 MR super cages connected to each other through 10 MR windows. The crystal system of the MWW framework is hexagonal and the molecules diffuse along the [100] directions in the zeolite, i.e., there is no communication along the c direction between the pores. In the hexagonal plate-like crystals of the MWW type zeolites, the crystals are formed of relatively small number of units along the c direction as a result of which, much of the catalytic activity is due to active sites located on the external surface of the crystals in the form of the cup-shaped cavities. In the interior structure of certain members of the family such as MCM-22, the cup-shaped cavities combine together to form a supercage. The MCM-22 family of zeolites has attracted significant scientific attention since its initial announcement by Leonovicz et al. in Science 264, 1910-1913 [1994] and the later recognition that the family includes a number of zeolitic materials such as PSH 3, MCM-22, MCM 49, MCM 56, SSZ 25, ERB-1, ITQ-1, and others. Lobo et al. AIChE Annual Meeting 1999, Paper 292J.

The relationship between the various members of the MCM-22 family have been described in a number of publications. Three significant members of the family are MCM-22, MCM-36, MCM-49, and MCM-56. When initially synthesized from a mixture including sources of silica, alumina, sodium, and hexamethylene imine as an organic template, the initial product will be MCM-22 precursor or MCM-56, depending upon the silica: alumina ratio of the initial synthesis mixture. At silica:alumina ratios greater than 20, MCM-22 precursor comprising H-bonded vertically aligned layers is produced whereas randomly oriented, non-bonded layers of MC-56 are produced at lower silica:alumina ratios. Both these materials may be converted to a swollen material by the use of a pillaring agent and on calcination, this leads to the laminar, pillared structure of MCM-36. The as-synthesized MCM-22 precursor can be converted directly by calcination to MCM-22 which is identical to calcined MCM-49, an intermediate product obtained by the crystallization of the randomly oriented, as-synthesized MCM-56. In MCM-49, the layers are covalently bonded with an interlaminar spacing slightly greater than that found in the calcined MCM-22/MCM 49 materials. The unsynthesized MCM-56 may be calcined itself to form calcined MCM 56 which is distinct from calcined MCM-22/MCM-49 in having a randomly oriented rather than a laminar structure. In the patent literature MCM-22 is described in U.S. Pat. No. 4,954,325 as well as in U.S. Pat. Nos. 5,250,777; 5,284,643 and 5,382,742. MCM-49 is described in U.S. Pat. No. 5,236,575; MCM-36 in U.S. Pat. No. 5,229,341 and MCM-56 in U.S. Pat. No. 5,362,697.

The preferred zeolitic material for use as the MWW component of the catalyst system is MCM-22. It has been found that the MCM-22 may be either used fresh, that is, not having been previously used as a catalyst or alternatively, regenerated MCM-22 may be used. Regenerated MCM-22 may be used after it has been used in any of the catalytic processes for which it is known to be suitable but one form of regenerated MCM-22 which has been found to be highly effective in the present condensation process is MCM-22 which is previously been used for the production of aromatics such as ethylbenzene or cumene, normally using reactions such as alkyaltion and transalkylation. The cumene production (alkylation) process is described in U.S. Patent No. U.S. Pat. No. 4,992,606 (Kushnerick et al). Ethylbenzene production processes are described in U.S. Pat. No. 3,751,504 (Keown); U.S. Pat No. 4,547,605 (Kresge); and U.S. Pat No. 4,016,218 (Haag); U.S. Pat. Nos. 4,962,256; 4,992,606; 4,954,663; 5,001,295; and 5,043,501 describe alkylation of aromatic compounds with various alkylating agents over catalysts comprising MWW zeolites such as PSH-3 or MCM-22. U.S. Pat. No. 5,334,795 describes the liquid phase synthesis of ethylbenzene with MCM-22.

The MCM-22 catalysts may be regenerated after catalytic use in the cumene, ethylbenzene and other aromatics production processes by conventional air oxidation techniques similar to those used with other zeolite catalysts.

Intermediate Pore Size Zeolite

As noted above, it may be desirable to carry out a second alkylation step using different conditions in order to react the lighter portion of the olefin feed, predominantly ethylene, with additional aromatic feed. In this case, the reaction is preferably carried out in the vapor phase under higher temperature conditions using an different molecular sieve catalyst containing an intermediate pore size zeolite such as ZSM-5 which is more active for ethylene/aromatic alkylation. This family of zeolites is characterized by an effective pore size of generally less than about 0.7 nm, and/or pore windows in a crystal structure formed by 10-membered rings. The designation "intermediate pore size" means that the zeolites in question generally exhibit an effective pore aperture in the range of about 0.5 to 0.65 nm when the molecular sieve is in the H-form. The effective pore size of zeolites can be measured using standard adsorption techniques and compounds of known minimum kinetic diameters. See Breck, Zeolite *Molecular Sieves,* 1974 (especially Chapter 8), and Anderson et al, *J. Catalysis* 58,114 (1979).

The medium or intermediate pore zeolites are represented by zeolites having the structure of ZSM-5, ZSM-11, ZSM-23, ZSM-35, ZSM-48 and TMA (tetramethylammonium) offretite. Of these, ZSM-5 and ZSM-11 are preferred for functional reasons while ZSM-5 is preferred as being the one most readily available on a commercial scale from many suppliers.

The activity of the two zeolitic component of the catalyst or catalysts used in the present process is significant. The acid activity of zeolite catalysts is conveniently defined by the alpha scale described in *J. Catalysis,* Vol. VI, pp. 278-287 (1966). In this text, the zeolite catalyst is contacted with hexane under conditions presecribed in the publication, and the amount of hexane which is cracked is measured. From this measurement is computed an "alpha" value which characterizes the catalyst for its cracking activity for hexane. This alpha value is used to define the activity level for the zeolites. For the purposes of this process, the catalyst should have an alpha value greater than about 1.0; if it has an alpha value no greater than about 0.5, will be considered to have substantially no activity for cracking hexane. The alpha value of the intermediate pore size zeolite of the ZSM-5 type preferentially used for the ethylene/aromatic reaction is preferably at least 10 or more, for example, from 50 to 100 or even higher. The alpha value of the MWW zeolite preferably used in the liquid phase reaction is less critical although values of at least 1 are required for perceptible activity higher values over 10 are preferred.

Catalyst Matrix

In addition to the zeolitic component, the catalyst will usually contain a matrix material or binder in order to give adequate strength to the catalyst as well as to provide the desired porosity characteristics in the catalyst. High activity catalysts may, however, be formulated in the binder-free form by the use of suitable extrusion techniques, for example, as described in U.S. Pat. No. 4,908,120. When used, matrix materials suitably include alumina, silica, silica alumina, titania, zirconia, and other inorganic oxide materials commonly used in the formulation of molecular sieve catalysts. For use in the present process, the level of MCM-22 or ZSM-5 type (intermediate pore size) zeolite in the finished matrixed catalyst will be typically from 20 to 70% by weight, and in most cases from 25 to 65% by weight. In manufacture of a matrixed catalyst, the active ingredient will typically be mulled with the matrix material using an aqueous suspension of the catalyst and matrix, after which the active component and the matrix are extruded into the desired shape, for example, cylinders, hollow cylinders, trilobe, quadlobe, etc. A binder material such as clay may be added during the mulling in order to facilitate extrusion, increase the strength of the final catalytic material and to confer other desirable solid state properties. The amount of clay will not normally exceed 10% by weight of the total finished catalyst. Unbound (or, alternatively, self-bound) catalysts are suitably produced by the extrusion method described in U.S. Pat. No. 4,582,815, to which reference is made for a description of the method and of the extruded products obtained by its use. The method described there enables extrudates having high constraining strength to be produced on conventional extrusion equipment and accordingly, the method is eminently suitable for producing the catalysts which are silica-rich. The catalysts are produced by mulling the zeolite with water to a solids level of 25 to 75 wt % in the presence of 0.25 to 10 wt % of basic material such as sodium hydroxide. Further details are to be found in U.S. Pat. No. 4,582,815.

Product Formation

During the alkylation process, a number of mechanistically different reactions take place. The olefins in the feed react with the single ring aromatics in the aromatic feed to form high-octane number single ring alkylaromatics. As noted above, the ethylene-aromatic alkylation reactions are favored over intermediate pore size zeolite catalysts while propylene-aromatic reactions being favored over MWW zeolite catalysts.

The principle reactions of alkylation and transalkylation reactions between the aromatics and the olefins will predominate significantly over the minor degree of olefin oligomerization which occurs since the aromatics are readily sorbed onto the catalyst and preferentially occupy the catalytic sites making olefin self-condensation reactions less likely to occur as long as sufficient aromatics are present. Reaction rates and thermodynamic considerations also favor direct olefin-aromatic reactions. Whatever the involved mechanisms are, however, a range of alkylaromatic products can be expected with varying carbon numbers.

The objective normally will be to produce products having a carbon number no higher than 14 and preferably not above 12 since the most valuable gasoline hydrocarbons are at $C_7$-$C_{12}$ from the viewpoint of volatility including RVP and engine operation at varying conditions. Di-and tri-alkylation is therefore preferred since with the usual $C_2$, $C_3$ and $C_4$ olefins and a predominance of benzene in the aromatic feed, alkylaromatic products with carbon numbers from about 10 to 14 are readily achievable. Depending on the feed composition, operating conditions and type of unit, the product slate may be varied with optimum conditions for any given product distribution being determined empirically.

After separation of light ends from the final reactor effluent stream, the gasoline boiling range product is taken from the stripper or fractionator. Because of its content of high octane number alkylaromatics, it will normally have an octane number of at least 92 and often higher, e.g. 95 or even 98. This product forms a valuable blend component for the refinery blend pool for premium grade gasoline.

Process Parameters

The present process is notable for its capability of being capable of operation at low to moderate pressures. In general, pressures up to about 7,500 kPag (approximately 1,100 psig) will be adequate. As a matter of operating convenience and economy, however, low to moderate pressures up to about 3,500 kPag (about 500 psig) will be preferred, permitting the use of low pressure equipment. Pressures within the range of about 700 to 15,000 kPag (about 100 to 2,175 psig) preferably 1500 to 4,000 kPag (about 220 to 580 psig) will normally be suitable.

In the liquid phase operation, the overall temperature will be from about 90° to 250° C. (approximately 196° to 480° F.), usually not more than 200° C. (about 390° F.). The temperature may be controlled by the normal expedients of controlling feed rate, and operating temperature or, if required by dilution or quench. If the additional vapor phase step is used, reaction conditions will be more forcing over the intermediate pore size zeolite to attain the desired ethylene conversion as described in application Ser. No. 60/656,945 (U.S. 2006/0194997) "Vapor Phase Alkylation Process", for example, 200° to 325° C. (approximately 400° to 620° F.).

Space velocity on the olefin feed will normally be from 0.5 to 5.0 WHSV ($hr^{-1}$) and in most cases from 0.75 to 3.0 WHSV ($hr^{-1}$) with a value in the range of 1.0 to 2.5 WHSV ($hr^{-1}$) being a convenient operating value. The ratio of aromatic feed to olefin will depend on the aromatic content of the feed, principally the benzene content which is to be converted to alkylaromatics and the utilization of the aromatics and olefins under the reaction conditions actually used. Normally, the aromatics:olefin ratio will be from about 0.5:1 to 5:1 by weight and in most cases from 1:1 to 2:1 by weight. No added hydrogen is required.

The invention claimed is:

1. A method for producing a gasoline boiling range product from a mixed light olefin feed stream including ethylene and propylene and a liquid aromatic feed stream including single ring aromatic compounds, which process comprises:

extracting light olefins from an olefinic gas stream comprising ethylene and propylene by counterflow dissolution at a temperature up to 120° C. and a pressure up to 3500 kPag, into a stream of light aromatic hydrocarbons which contains benzene to form an extract stream comprising extracted olefins in the aromatic hydrocarbons and a stream comprising unsorbed olefins, alkylating the aromatics in the extract stream with the extracted olefins dissolved in the aromatic hydrocarbon stream over a fixed bed of a solid molecular sieve alkylation catalyst comprising a zeolite of the MWW family in a liquid phase reaction at a temperature of not more than 250° C. , an aromatics:olefin ratio from 0.5:1 to 5:1 by weight and an olefin space velocity from 0.5 to 5.0 WHSV, to form a gasoline boiling range product containing akylaromatics including alkylbenzenes, passing the stream comprising unsorbed olefins to a vapor phase alkylation step in which the olefins in this stream contact an additional stream of the aromatic feed to alkylate aromatics in the stream with unsorbed olefins in a fixed bed catalytic, vapor phase reaction over a catalyst comprising an intermediate pore size zeolite which is more active for ethylene conversion than the MWW type zeolite used in the liquid phase alkylation reaction, at a temperature which is higher than that used in the liquid phase alkylation step, to produce alkylate aromatics including alkylbenzenes.

2. A method according to claim 1 in which the aromatic feed stream comprises a reformate.

3. A process according to claim 1 in which the mixed light olefin feed stream comprises $C_2$ to $C_4$ olefins.

4. A process according to claim 1 in which the zeolite of the MWW family comprises MCM-22.

5. A method according to claim 4, in which the olefinic feed stream is reacted with the aromatic feed stream in the presence of the MCM-22 zeolite catalyst at a temperature from 150 to 250° C.

6. A method according to claim 5, in which the olefinic feed stream is reacted with the aromatic feed stream in the presence of the MCM-22 zeolite catalyst at a temperature from 150 to 200° C.

7. A method according to claim 1 in which the aromatic feed stream is a reformate stream which contains from 5 to 60 weight percent benzene.

8. A method according to claim 7 in which the aromatic feed stream contains from 25 to 40 weight percent benzene.

9. A method according to claim 1, in which the olefinic feed stream is reacted with the aromatic feed stream in the presence of the MWW family zeolite catalyst at a pressure not more than 3,000 kPag.

10. A process according to claim 1 in which the intermediate pore size zeolite which is more active for ethylene conversion than the MWW type zeolite is zeolite ZSM-5.

* * * * *